US005996546A

United States Patent [19]

Kollmann et al.

[11] Patent Number: 5,996,546

[45] Date of Patent: Dec. 7, 1999

[54] INTEGRATED FLYWHEEL COVER AND AIR CONDUIT PASSAGES

[75] Inventors: James D. Kollmann, Mt. Calvary; Mark A. Ruman, Fond du Lac; George D. Idzikowski, Lomira; Bernard E. Ritger, Fond du Lac, all of Wis.

[73] Assignee: Brunswick Corporation, Lake Forest, Ill.

[21] Appl. No.: 08/898,362

[22] Filed: Jul. 22, 1997

[51] Int. Cl.[6] ..... F02B 77/00

[52] U.S. Cl. ..... 123/195 C; 123/195 P

[58] Field of Search ..... 123/195 C, 195 P, 123/198 E, 41.7; 440/900; 181/229

[56] References Cited

U.S. PATENT DOCUMENTS

| | | | |
|---|---|---|---|
| 2,914,133 | 11/1959 | Johnson | 181/229 |
| 3,195,530 | 7/1965 | Heidner | 123/198 R |
| 3,610,198 | 10/1971 | Alexandrowicz | 440/77 |
| 4,257,368 | 3/1981 | Hofbauer | 123/195 C |
| 4,608,950 | 9/1986 | Payne et al. | 123/195 C |
| 4,721,485 | 1/1988 | Suzuki | 440/77 |
| 4,734,070 | 3/1988 | Mondek | 440/88 |
| 4,760,704 | 8/1988 | Torigai | 60/612 |
| 4,874,959 | 10/1989 | Sheridan | 290/1 B |
| 4,968,276 | 11/1990 | Hashimoto | 440/77 |
| 4,978,321 | 12/1990 | Ferguson | 440/88 |
| 5,083,538 | 1/1992 | Hubbell | 123/198 E |
| 5,133,307 | 7/1992 | Kurihara | 123/52 |
| 5,445,547 | 8/1995 | Furukawa | 440/77 |
| 5,488,939 | 2/1996 | Nakai | 123/572 |
| 5,501,202 | 3/1996 | Watanabe | 123/572 |

*Primary Examiner*—Noah P. Kamen
*Assistant Examiner*—Hai Huynh
*Attorney, Agent, or Firm*—William D. Lanyi

[57] ABSTRACT

A cover for an outboard motor is provided to protect an operator from a flywheel. The cover is disposed under the cowl of the outboard motor. The cover is made of a generally rigid material, such as plastic, with first and second sheets being associated together to form conduits with openings extending therefrom. In one particular embodiment, one of the openings is shaped to receive an inlet of a compressor and this provides a positioning aid in attaching the cover to the engine. This device eliminates the need for flexible hoses and accomplishes two tasks with one component. It provides air conduits for the air passing through the cover and it provides a generally rigid means for locating the proper location of the cover.

12 Claims, 2 Drawing Sheets

INTEGRATED FLYWHEEL COVER AND AIR CONDUIT PASSAGES

BACKGROUND OF THE INVENTION

1. Field of the Invention

The present invention is generally related to a cover structure that is specifically shaped to comprise air conduits and, more particularly, to a flywheel cover for an outboard motor which has fluid passages formed therein for the purpose of conducting air between an inlet opening and an outlet opening.

2. Description of the Prior Art

It is well known to those skilled in the art that certain components of an outboard motor, such as a flywheel and other moving parts, should be covered in order to protect the operator when the cowl is removed. In certain applications of outboard motors, the flywheel cover is provided with an opening in its surface through which air can flow. Typically, an air filter is placed within a chamber at the inlet opening and a hose is connected in fluid communication with the chamber to direct a flow of air towards the inlet of a compressor. In other applications, the hose which is connected to the air compressor is not connected to the flywheel cover, but, instead, is independently supported by other means.

Another flow of air is directed from a region around the outside surface of the internal combustion engine toward the air inlet of the engine. This flow of air also passes along a path under the flywheel cover. In certain applications, individual sound dampening structures are used to reduce the noise caused by the air flow.

U.S. Pat. No. 5,133,307, which issued to Kurihra on Jul. 28, 1992, discloses an air intake system for a marine propulsion engine. The air intake system is provided with an U-shape configuration for facilitating water separation and to provide a long intake passage. An air flow sensor is positioned at the inlet opening of the inlet device with the lift being the inlet opening and the intake port being effective to dampen pulsations in the induction systems from the air flow device.

U.S. Pat. No. 5,501,202, which issued to Watanabe on Mar. 26, 1996, describes an engine component layout for an outboard motor. The engine of an outboard motor includes an improved engine component layout in order to minimize the size of the engine and to improve the performance of the components. A separator of a crankcase ventilation system is located on a cam cover outside the cam chamber in order to reduce the size of the cam cover while providing the necessary spacing between the separator and the valve mechanism within the cam chamber. A fuel pump is positioned at about the center of the cam cover, beneath the separator, in order to generally balance the length of fuel travel to each of the carburetors. A fuel filter is located on the cam cover and positioned to generally isolate the fuel filter from the effects of the heated cylinder head and block. The arrangement of these components does not interfere with the hingelike travel of the top cowling, which surrounds the engine, relative to a lower tray.

U.S. Pat. No. 4,760,704, which issued to Torigai on Aug. 2, 1988, describes a multi-cylinder engine with a turbo charger. A number of embodiments of a two-cycle, turbo-charged internal combustion engine are described in this patent for providing an improved arrangement for locating the inlet of the turbine stage so as to minimize the necessity for back flow in the exhaust conduit. A number of embodiments are also illustrated for applying this principal to outboard motors and in many of the embodiments, twin turbo-charges are employed. The turbo-chargers are disposed in such a relationship so as to permit a compact relationship and to avoid close proximity between the exhaust conduits and the compressor stages.

U.S. Pat. No. 5,488,939, which issued to Nakai et al on Feb. 6, 1996, discloses a crankcase ventilation system for an outboard motor. The ventilation system is provided for an engine crankcase of a marine outboard motor in order to distribute blow-by gas generally equally to each cylinder while minimizing the size of an intake silencer of the system. The intake silencer includes a first expansion chamber into which the blow-by gas is introduced from a blow-by gas chamber attached to the cylinder head. The blow-by gas diffuses and mixes with ambient air which is drawn into the first expansion chamber through an inlet port of the induction system. The air/blow-by gas mixture is then drawn into a second expansion chamber where it distributes generally evenly before induction into a charged forming device.

Because of the need of arranging components of an outboard motor efficiently while also performing the necessary functions, which include directing air to an air compressor and to the air inlet of the internal combustion engine, it would be beneficial if a means could be provided for combining the functions of two or more components of the outboard motor. For example, it would be particularly beneficial if a flywheel cover could be constructed in a way that eliminates the need for separate hoses to direct air flow to the air compressor and to the air inlet of the internal combustion engine while also serving as a locator to properly position the flywheel cover on the engine. If these functions could be performed by the flywheel cover, in addition to the normal function of providing protection for an operator when the cowl is removed, a significant improvement in the structure of an outboard motor could be achieved.

SUMMARY OF THE INVENTION

The present invention provides a cover for an engine that comprises a first sheet of a first material which is shaped to form a protection member over a selected portion of the engine. The first sheet is sufficiently rigid to maintain its shape during normal usage of the engine and normal handling. A second sheet of a second material is attached to the first sheet and spaced apart from the first sheet in order to form a fluid conduit there between. The second sheet is sufficiently rigid to maintain its shape during normal usage of the engine and normal handling.

A first opening is formed in the fluid conduit in order to admit a gas into the fluid conduit and the second opening is formed in the fluid conduit to permit the gas to flow out of the fluid conduit. The fluid conduit is shaped to direct the flow of gas from the first opening to the second opening. The first and second openings are maintained at a fixed spatial relationship, relative to each other and relative to the cover, by the rigidity of the first and second sheets.

In a particularly preferred embodiment of the present invention, a means is also provided for affecting a characteristic of the gas. The affecting means is disposed in fluid communication with the fluid conduit. The affecting means can be an air filter to clean the air and the first opening can be disposed in fluid communication with a region under the cover and approximate the engine. The second opening is then disposed in fluid communication with an air compressor inlet in this embodiment of the present invention.

The affecting means could alternatively be a sound dampening structure. In this embodiment, the first opening is disposed of fluid communication with a region approximate the engine and the second opening is disposed with fluid communication with an air intake of the engine.

The cover can be disposed over a flywheel of the engine in certain embodiments of the present invention and, in certain embodiments, the first and second materials can be the same. The first and second materials can be a plastic with sufficient rigidity and thickness to maintain its shape during normal operation of the engine and normal handling. This rigidity also serves to allow certain parts of the present invention to be used as positioning devices for the cover. As a example, the second opening can be used, when placed over an inlet of a compressor, as a locator for the position of the flywheel cover. The engine can be a marine engine and the marine engine can be an outboard motor.

In a typical application of the present invention, the second sheet is bent in order to define a channel with two edges extending toward a surface of the first sheet. The two edges of the second sheet are then attached to a surface of the first sheet in order to form the fluid conduit.

BRIEF DESCRIPTION OF THE DRAWING

The present invention will be more fully and completely understood from a reading of the description of the preferred embodiment in conjunction of the drawings, in which.

DESCRIPTION OF THE PREFERRED EMBODIMENT

Figure 1:
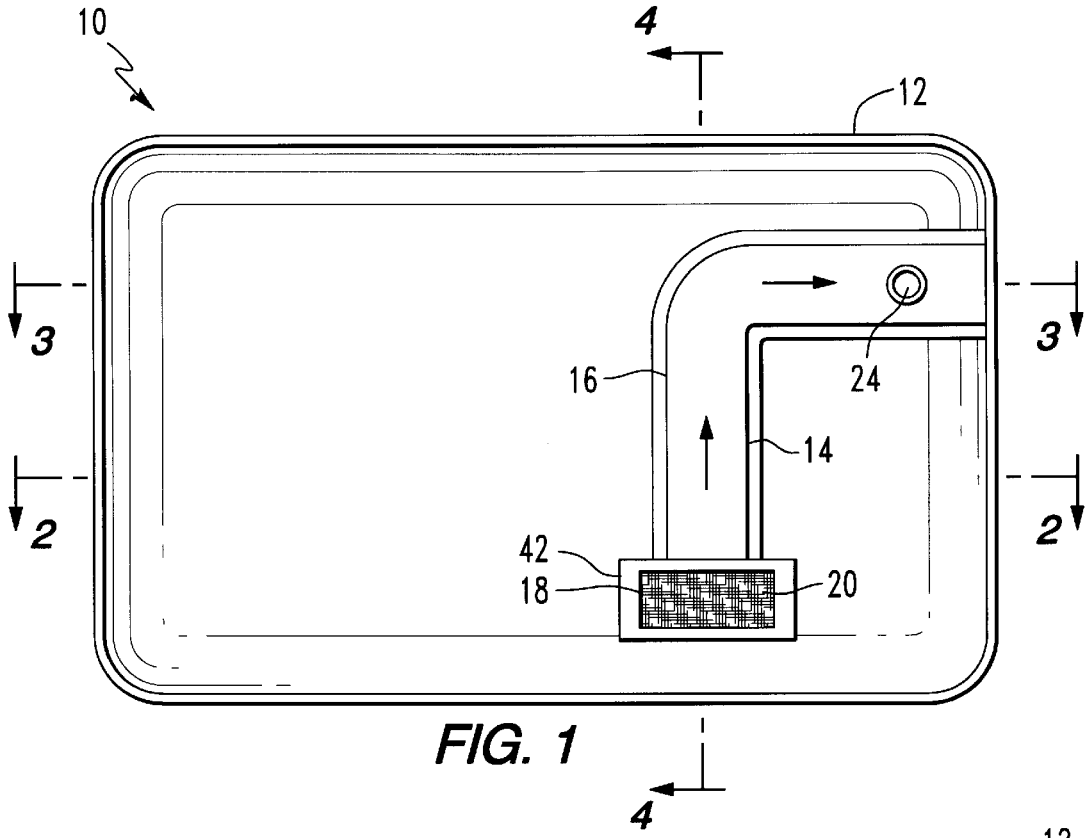
FIG. 1 shows a view of the underside of a flywheel cover made in accordance with the present invention.

Throughout the description of the preferred embodiment, like components will be identified by like reference numerals.

FIG. 1 is a highly schematic representation of a flywheel cover 10 showing the underside of the cover. The flywheel cover 10 comprises a first sheet 12 of a first material that is formed into a generally bowl-like shape to serve as a cover for the flywheel and other moving parts of an outboard motor. A second sheet 14 of a second material is shaped to form a channel that when attached to the first sheet 12, forms an air flow conduit 16 that is capable from directing air from one location to another. A first opening 18 is formed in fluid communication with the fluid conduit 16 between the first and second sheet of the material. In FIG. 1, a filter 20 is disposed in the first opening 18 for the purpose of filtering the air flowing into the first opening. A second opening 24 is formed in the fluid conduit 16 in order to permit air to exit from the fluid conduit.

In operation, air is received through the air filter 18 at the first opening 20 and flows through the fluid conduit 16, in a direction represented by the arrow in FIG. 1, toward the second opening 24 where it is able to flow out from the fluid conduit 16. It should be appreciated that the structures shown in FIG. 1 are generally rigid and maintain their shape during normal usage and handling. It should also be appreciated that an alternative prior art scheme for constructing the outboard motor would be to provide an individual cover 12 and a separate rubber hose connected between an air compressor and an air inlet. The second opening 24, shown in FIG. 1, is shaped to receive the inlet of an air compressor in a preferred embodiment of the present invention.

Figure 2:
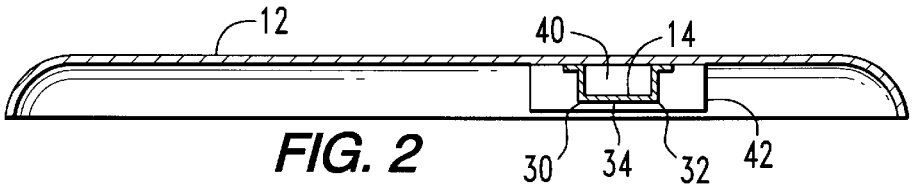
FIG. 2 is a section view of FIG. 1.

FIG. 2 is a section view taken through the fluid conduit 16 in FIG. 1. In FIG. 2, it can be seen that the second sheet 14 is bent along two generally parallel lines to form corners 30 and 32. This forms a three sided channel with two edges extending toward a central surface 34 of the first sheet in a common direction. These edges can then be attached to the first sheet 12, either by rivets, glue or by selectively melting portions of the second sheet to fuse it to the first sheet. The space trapped between the first and second sheet, identified by reference numeral 40 in FIG. 2, provides the fluid conduit 16. Also shown in FIG. 2 is a housing 42 that is connected in fluid communication with the fluid conduit 16 with the purpose of containing the air filter 20 shown in FIG. 1. This housing 42 is not required in all embodiments of the present invention.

Figure 3:
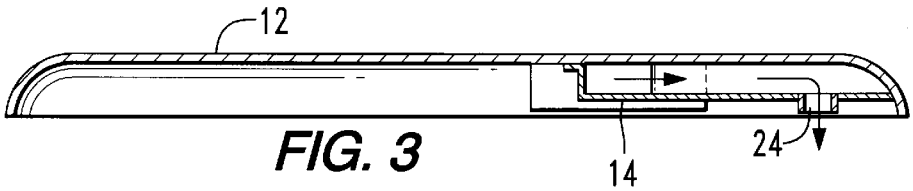
FIG. 3 is a section view of FIG. 1.

FIG. 3 is a section view taken through the fluid conduit 16 and second opening 24 of FIG. 1. FIG. 3 illustrates how the channel between the first 12 and second 14 sheets creates a conduit through which air can flow. The air, represented by the arrow in FIG. 3, flows through the fluid conduit from the first opening 18 to the second opening 24. The structure of the second opening 24 shown in FIG. 3 is shaped to fit over an inlet tube of a compressor. This, combined with the rigidity of the overall structure, serves to accurately locate the position of the flywheel cover 10 relative to the other components of the outboard motor.

Figure 4:
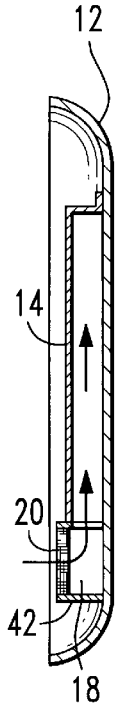
FIG. 4 is a section view of FIG. 1.

FIG. 4 is another sectional view of FIG. 1 taken through the first opening 18 and the housing 42 in which the air filter 20 is disposed.

Figure 5:
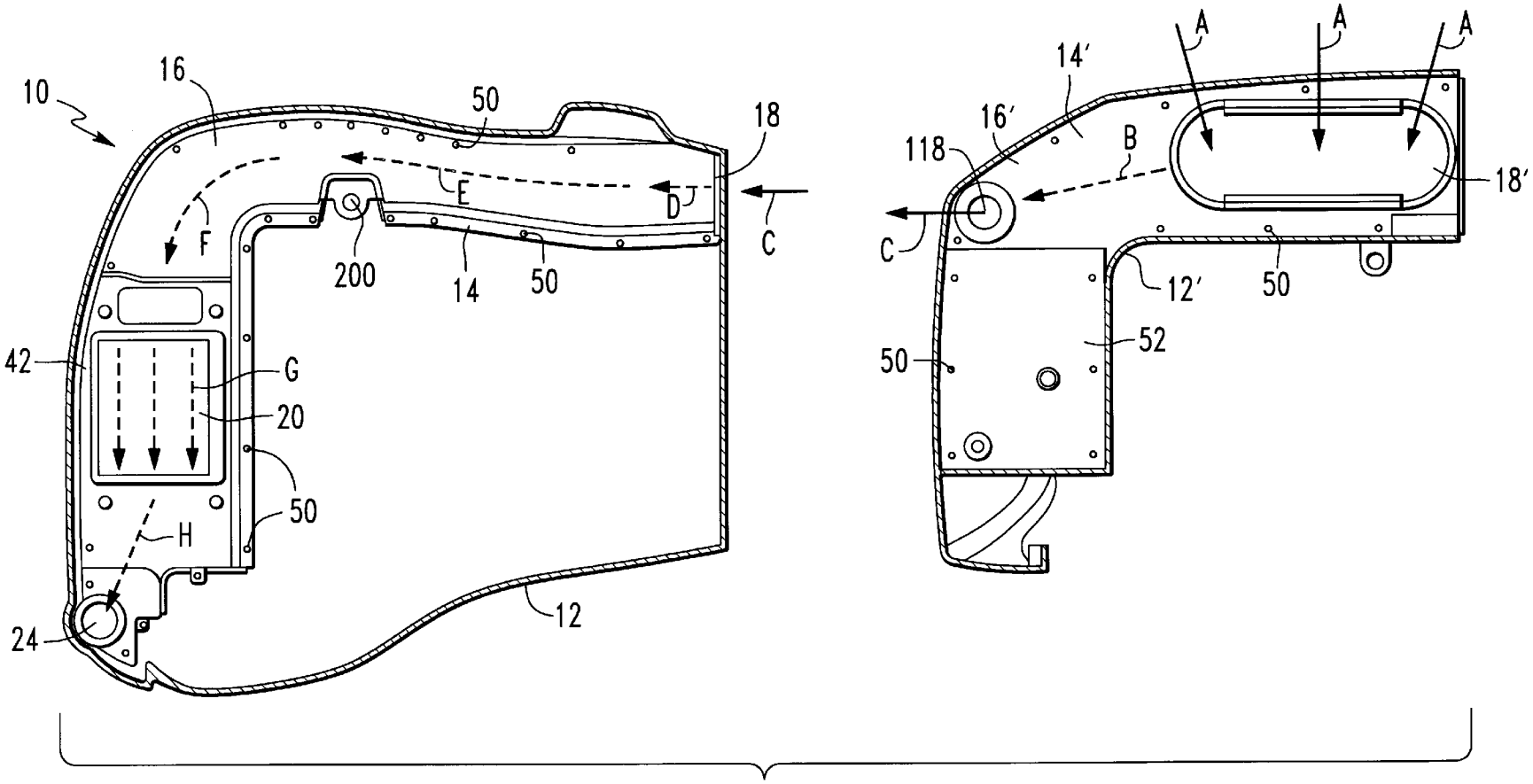
FIG. 5 is a view of the present invention which illustrates a preferred embodiment of the present invention.

FIG. 5 illustrates one particularly preferred embodiment of the present invention. In FIG. 5, a top portion of a cover is shown on the left side of the illustration and the front portion of the cover is shown on the right side of the illustration. The top and front portions are separate components that are associated together when assembled on the engine. When assembled, the cover on the right is rotated relative to the cover on the left so that opening 118 is disposed at opening 18 in the top cover shown on the left side of FIG. 5. In FIG. 5, both the top cover on the left and the front cover on the right are illustrated to show the underside of both sections. The flywheel cover 10, on the left, comprises the first sheet 12 and the second sheet 14 which is attached to the first sheet by a plurality of plastic rivets 50. In certain applications, a sealant can be applied at the interface between the first sheet 12 and the edges of the second sheet 14. The application of an additional sealant helps to eliminate possible leaks from the conduit 16 of air that enters through the first opening 18.

With continued reference to FIG. 5, an alternative adaptation of the present invention is effected in the front cover on the right side of the Figure by the second sheet 14 which is attached to the first sheet 12' by plastic rivets 50 to create the conduit 16' through which air can flow between a first opening 18' and a opening 118. The air flows in the direction of arrow B under the second sheet 14' in FIG. 5 and through the space trapped between the first and second sheets. In the application shown at the right side of FIG. 5, the primary purpose of the conduit 16' is to direct air from a region near the outside surface of the internal combustion engine toward the air inlet of the engine. This air flow is illustrated by arrow A. At the first opening 18', a sound baffle 52 is provided. Once received at opening 18', the air flows into conduit 16' and is directed toward opening 118.

After the air enters opening 18' and flows through conduit 16', as illustrated by arrow B, the air exits from the conduit 16' through opening 118 and immediately into opening 18 of the top cover shown on the left side of FIG. 5. After the air moves from the front cover to the top cover, as represented by arrows C, it passes through opening 18 and is directed through conduit 16 as illustrated by arrows D, E, and F. Then the air is directed through a filter 20 in the containment 42, as represented by arrows G. It should be noted that the embodiment shown in FIG. 5 causes the air to move through the filter 20 as it passes in a linear toward the second opening 24 whereas the embodiment described above in conjunction with FIG. 1–4, causes the air to turn perpendicularly prior to passing through the filter and out of the conduit 16. In the embodiment shown in FIG. 5, the air continues to flow in the direction represented by arrow H after passing through the filter 20 until it reaches the second opening 24. As in the other embodiment, opening 24 is shaped to receive an inlet port of a compressor. When the second opening 24 is placed over the inlet port of the compressor, it rigidly fixes the position of the second opening 24 relative to the internal combustion engine. Another locating point, such as that identified by reference numeral 200 in FIG. 5, can be used to positively enter the top cover 10 relative to the engine because of the rigidity of the first and second sheets of material.

The top and side covers shown in FIG. 5 represent two different embodiments of the present invention. The flywheel cover shown at the left of FIG. 5 affects the flow of air in two ways. First, it filters the particulates from the air stream through the use of the filter 20. In addition, the rigidity of the first and second sheets allows the conduit 16 to be shaped with legs that are a predetermined length and which tunes the flow of air to advantageously affect the operation of the engine. Without this tuning characteristic, the flow of air to the compressor might be adversely affected by pulsations created as the air flows along the path between opening 18 and opening 24. The embodiment of the present invention shown on the right side of FIG. 5 affects the sound characteristic of the air flow by providing a baffle 52 which serves to dampen the sound vibrations of the air stream. The embodiment on the left of FIG. 5 filters the air prior to directing it toward the air compressor and the embodiment on the right dampens the sound of the moving air as it is received and directed toward the air intake of the engine. Both embodiments of the present invention shown in FIG. 5 affect a characteristic of the gas flowing through the conduits. The embodiment on the left affects the characteristic of the amount of particulates that may be carried by the air as it enters the first opening 18. This affecting means is the air filter 20. The embodiment on the right in FIG. 5 affects the sound emanating from the moving air as it passes from the first opening 18 prime to the second opening 24 prime. In combination, the two embodiments shown in FIG. 5 can serve to facilitate the location of the flywheel cover 10 relative to the internal combustion engine. For example, the second opening 24 shown on the left side of FIG. 5 can be shaped to fit snugly over the inlet of a compressor. This relative shaping of the second opening 24 and the inlet of the compressor allows the cover 10 to be fixed in position with the lower left portion of the cover 10 shown in FIG. 5 being fixed at the location of the compressor inlet. Any other location on the cover 10, such as location 200, can be used to provide a second locating point. With two locating points the generally rigid structure of the present invention will accurately determine the proper position of the cover relative to the internal combustion engine.

The present invention provides a cover that serves many purposes and eliminates the need for separate components to perform those functions. For example, a flywheel cover made in accordance with the present invention provides the normal protection for an operator from the moving components of an engine when the cowl is removed. A cover made in accordance with the present invention also provides, in certain embodiments of the present invention, a fluid conduit that directs flow from a first opening to a second opening which is connected in fluid communication with the inlet of an air compressor. This concept can also be applied to direct a flow of air from a first inlet to a second inlet that is disposed in fluid communication with the air intake of the internal combustion engine. The first opening can be associated with an air filter or, alternatively a structure can be formed at the first opening for the purpose of dampening the sound caused by the air moving through the first conduit. By using generally rigid materials for the first and second materials used to make the first and second sheets, one of the openings can be used for the purpose of locating the position of the cover relative to the internal combustion engine and other components of the outboard motor.

The present invention reduces the manual assembly that would otherwise be required for attaching hoses to the compressor and other components of the outboard motor. It also removes the necessity for independently supporting hoses at locations near the outer surface of the engine.

Although the present invention has been described with particular detail and illustrated to show a specific embodiment of the present invention, it should be understood that other embodiments are also within its scope.

I claim:

1. A cover for an engine, comprising:

a first sheet of a first material shaped to form a protection member over a selected portion of said engine, said first sheet being sufficiently rigid to maintain its shape during normal usage of said engine;

a second sheet of a second material attached to said first sheet and spaced apart from said first sheet to form a fluid conduit therebetween, said second sheet being sufficiently rigid to maintain its shape during normal usage of said engine;

a first opening formed in said fluid conduit to admit a gas into said fluid conduit;

a second opening formed in said fluid conduit to permit said gas to flow out of said fluid conduit, said fluid conduit being shaped to direct the flow of said gas from said first opening to said second opening, said first and second openings being maintained at a fixed spatial relationship by the rigidity of said second sheet, said cover being disposed over a flywheel of said engine and a filter disposed in fluid communication with said fluid conduit, for affecting a characteristic of said gas, said first opening being disposed in fluid communication with a region under said cover and proximate said engine, said second opening being disposed in fluid communication with an air compressor inlet.

2. The cover of claim 1, wherein:

said first and second materials are the same.

3. The cover of claim 1, wherein:

said engine is a marine engine.

4. The cover of claim 3, wherein:

said marine engine is an outboard motor.

5. The cover of claim 1, wherein:

said second sheet is bent along two generally parallel lines to define a three sided channel with two edges extending perpendicularly to a central surface in a common direction, said two edges of said second sheet being attached to a generally planar surface of said first sheet to form said fluid conduit.

6. A cover for an engine, comprising:

a first sheet of a first material shaped to form a protection member over a selected portion of said engine, said first sheet being sufficiently rigid to maintain its shape during normal usage of said engine, said cover being disposed over a flywheel of said engine;

a second sheet of a second material attached to said first sheet and spaced apart from said first sheet to form a fluid conduit therebetween, said second sheet being sufficiently rigid to maintain its shape during normal usage of said engine;

a first opening formed in said fluid conduit to admit a gas into said fluid conduit;

a second opening formed in said fluid conduit to permit said gas to flow out of said fluid conduit, said fluid conduit being shaped to direct the flow of said gas from said first opening to said second opening, said first and second openings being maintained at a fixed spatial relationship by the rigidity of said second sheet; and a filter means, disposed in fluid communication with said fluid conduit, for affecting a characteristic of said gas, said first opening being disposed in fluid communication with a region under said cover and proximate said engine, said second opening being disposed in fluid communication with an air compressor inlet.

7. The cover of claim 6, wherein:

said first and second materials are the same.

8. The cover of claim 6, wherein:

said engine is a marine engine.

9. The cover of claim 8, wherein:

said marine engine is an outboard motor.

10. The cover of claim 6, wherein:

said second sheet is bent along two generally parallel lines to define a three sided channel with two edges extending perpendicularly to a central surface in a common direction, said two edges of said second sheet being attached to a generally planar surface of said first sheet to form said fluid conduit.

11. A cover for an engine, comprising:

a first sheet of a first material shaped to form a protection member over a selected portion of said engine, said first sheet being sufficiently rigid to maintain its shape during normal usage of said engine, said cover being disposed over a flywheel of said engine;

a second sheet of a second material attached to said first sheet and spaced apart from said first sheet to form a fluid conduit therebetween, said second sheet being sufficiently rigid to maintain its shape during normal usage of said engine, said first and second materials being identical, said engine being a marine internal combustion engine, said second sheet being bent along two generally parallel lines to define a three sided channel with two edges extending perpendicularly to a central surface in a common direction, said two edges of said second sheet being attached to a generally planar surface of said first sheet to form said fluid conduit;

a first opening formed in said fluid conduit to admit a gas into said fluid conduit;

a second opening formed in said fluid conduit to permit said gas to flow out of said fluid conduit, said fluid conduit being shaped to direct the flow of said gas from said first opening to said second opening, said first and second openings being maintained at a fixed spatial relationship by the rigidity of said second sheet; and a filter, disposed in fluid communication with said fluid conduit.

12. The cover of claim 6, wherein:

said engine is an outboard motor.

* * * * *